US005797058A

United States Patent [19]

Narukami

[11] Patent Number: 5,797,058

[45] Date of Patent: Aug. 18, 1998

[54] PHOTO-PROCESSING APPARATUS

[75] Inventor: Shinji Narukami, Wakayama, Japan

[73] Assignee: Noritsu Koki Co., Ltd., Wakayama

[21] Appl. No.: 528,098

[22] Filed: Sep. 14, 1995

[30] Foreign Application Priority Data

Sep. 19, 1994 [JP] Japan ..... 6-223146
Jul. 4, 1995 [JP] Japan ..... 7-168993

[51] Int. Cl.[6] ..... G03D 3/08
[52] U.S. Cl. ..... 396/615
[58] Field of Search ..... 354/319–324, 354/3; 396/615, 612, 620, 622; 226/118, 119, 15

[56] References Cited

U.S. PATENT DOCUMENTS 4,299,458 11/1981 Burton ..... 354/275 X
5,187,531 2/1993 Ozawa et al. ..... 354/277 X
5,455,653 10/1995 Shimamura et al. ..... 354/321 X

FOREIGN PATENT DOCUMENTS 0 519 867 A1 12/1992 European Pat. Off. .
6-214373 5/1994 Japan .
2 169 267 7/1986 United Kingdom .

*Primary Examiner*—D. Rutledge
*Attorney, Agent, or Firm*—Armstrong, Westerman, Hattori, McLeland & Naughton

[57] ABSTRACT

A photo-processing apparatus equipped with a stock tank section which contains and stores a strip-shaped photo-sensitive material between a pair of guide plates provided so as to sandwich the transversal direction of the photo-sensitive material; wherein the apparatus includes a tank width changing mechanism which changes a distance between the pair of guide plates depending on the width of the photo-sensitive material to be passed through the stock tank section. The paper to be contained and stored in the stock tank section does not twist and is smoothly pulled out from the exit section by a method wherein the distance between one pair of guide plates restricting the movement of the paper in the transversal direction is adjusted depending on the width of the paper to be passed through the stock tank section.

5 Claims, 8 Drawing Sheets

PHOTO-PROCESSING APPARATUS

BACKGROUND OF THE INVENTION

The present invention relates to a photo-processing apparatus, and more particularly to a photo-processing apparatus in which the movement in the transverse direction of the photo-sensitive material (hereinafter called, "paper") is restricted in a stock tank section so that the paper will not be twisted.

FIG. 1 shows one example of the configuration of a photo-processing apparatus. This photo-processing apparatus consists of a printer section 1 for printing papers and a processor section for performing a process on the printed paper such as developing.

The printer section 1 is further provided with a loading section 3 for transferring the paper to an exposure stand along a transfer path for the paper, an exposure stand 4 for exposing the paper to light to print it, an advance section 5 for accurately transferring the paper with a certain length, a paper transfer section 6, a stock tank section 7 where the a loop is formed to hold the paper so as to adjust the advancing speed of the paper to be sent to the processor section 2, and an exit section 8. Moreover, a processor rack section 9 is provided in the processing tank of the processor section 2 for conducting the coloring and developing, bleaching, and fixing and stabilizing, a dryer section 10 is provided in the drying tank for drying the paper, and a cutter section 11 is provided near the exit, respectively.

The strip-shaped paper contained in the paper magazine (not shown) in the form of a roll is pulled out and transferred by a transfer roller, and sent to the processor section 2 through the loading section 3, exposure stand 4, advance section 5 and paper transfer section 6. The stock tank section 7 is provided to adjust the advancing speed of the paper to be sent to the processor section 2, and is so designed that it is possible to contain the paper with a certain length in the stock tank section 7 with limited space by a method wherein a small loop is naturally formed in multi-fold laps as shown in FIG. 5.

Recently, the number of kinds of paper width that can be processed with a photo-processing apparatus has, increased so that the difference between the maximum width and minimum width has increased. If the size of the tank section in the transverse direction is determined in accordance with the maximum width, the minimum size paper will not be restricted in the transverse direction so that the loop is disordered as shown in FIG. 6. In worst cases, there is a problem that the paper cannot be pulled out from the stock tank section because of a twist.

In view of the above mentioned circumstances, it is an object of the present invention to provide a photo-processing apparatus in which the paper contained in the stock tank would not twist.

SUMMARY OF THE INVENTION

In accordance with an aspect of the present invention, there is provided a photo-processing apparatus equipped with a stock tank section which contains and stores a strip-shaped, photo-sensitive material between a pair of guide plates provided so as to sandwich the strip in the transverse direction along a material guide plate therethrough wherein the apparatus includes a path-width-changing mechanism which changes a distance between the pair of guide plates depending on the width of the photo-sensitive material to be passed through the stock tank section.

Moreover, in accordance with another aspect of the present invention, there is provided a photo-processing apparatus equipped with a stock tank section which contains and stores a strip-shaped photo-sensitive material between a pair of guide plates provided so as to sandwich the strip in the transverse direction along a material guide path therethrough; wherein the apparatus includes a path-width-changing mechanism which changes a distance between the pair of guide plates depending on the width of the photo-sensitive material to be passed through the stock tank section, and a supporting shaft rotation mechanism which rotates a supporting shaft for supporting the guide plates.

In the photo-processing apparatus of the present invention, the distance between a pair of guide plates, which are provided so as to sandwich the strip in the transverse direction along a material guide path therethrough and contains and stores the paper between them, is changed depending on the width of the paper to be passed through the stock tank section by means of a path-width-changing mechanism which is operative to restrict the movement of the paper in the transverse direction.

Moreover, when a supporting shaft-rotation mechanism is provided, the friction between the supporting shaft and the guide plates is reduced to smoothen the sliding of the guide plates.

DETAILED DESCRIPTION

Next, the photo-processing apparatus of the present invention is described with reference to the attached drawings.

Figure 1:
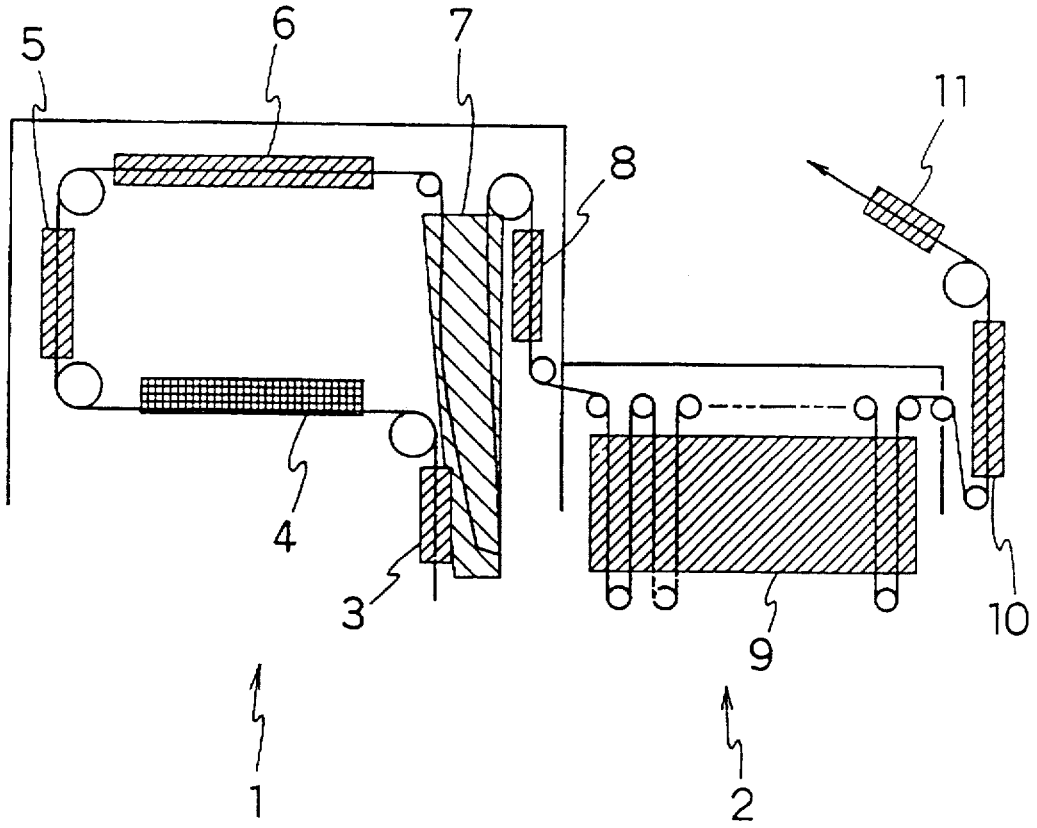
FIG. 1 is an explanatory view of an embodiment of a photo-processing apparatus of the present invention.
Figure 2:
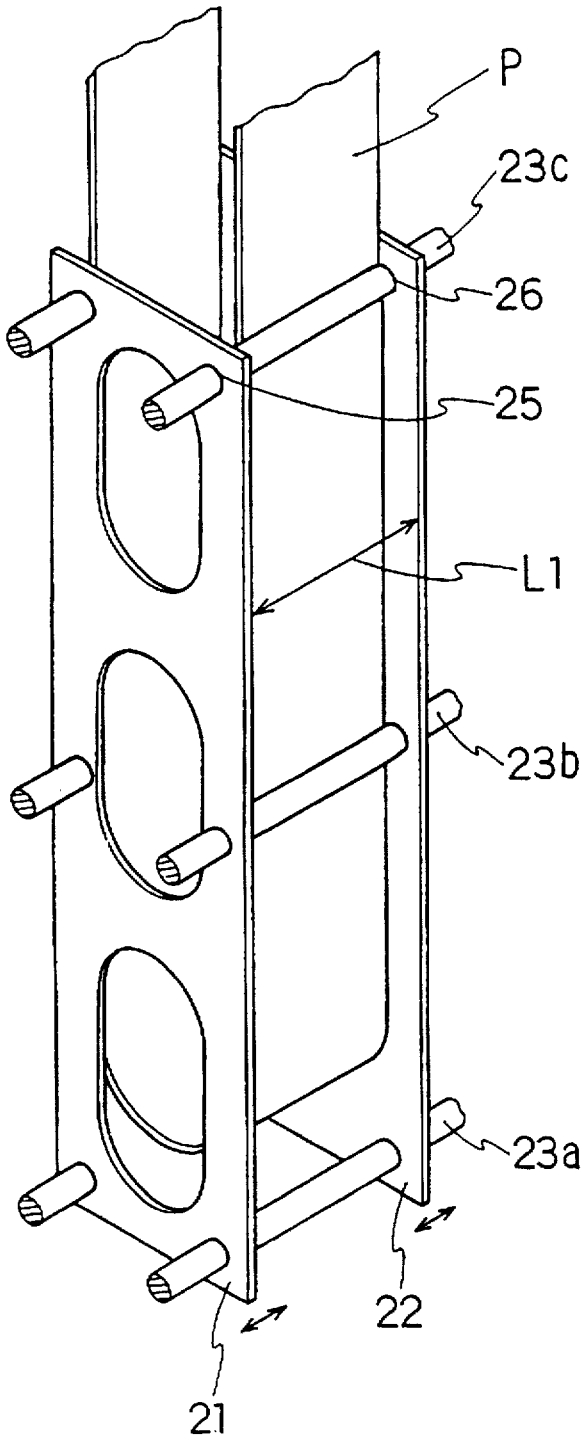
FIG. 2 is an explanatory schematic view of a pair of guide path in the stock tank section in the photo-processing apparatus of the present invention.
Figure 3:
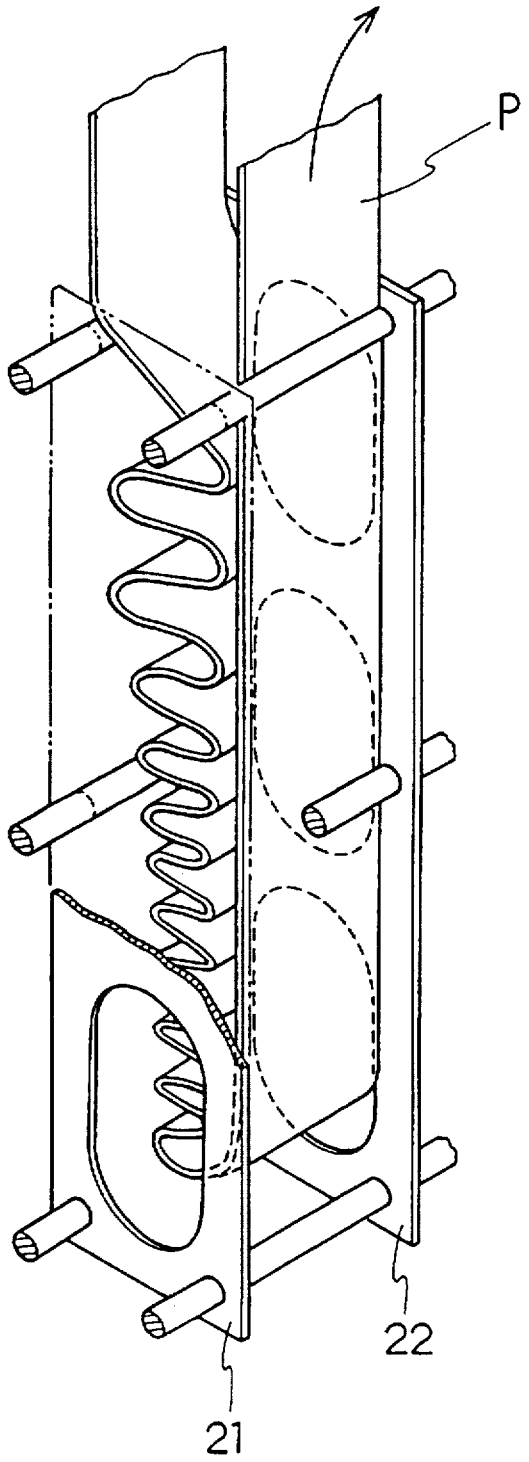
FIG. 3 illustrates a state of the paper to be contained in the stock tank section in FIG. 2.
Figure 4:
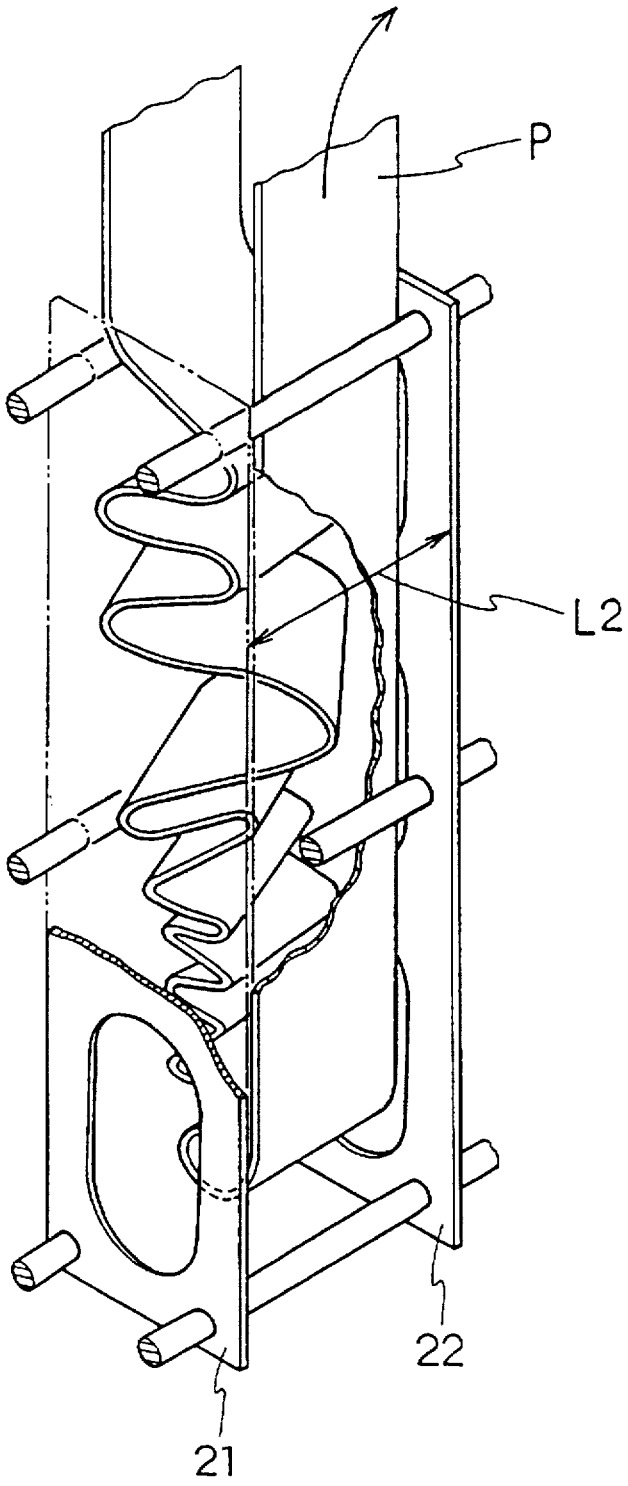
FIG. 4 illustrates a state of the paper in the case where the width of the material guide plates disposed in the stock tank section in FIG. 2 is not changed.
Figure 5:
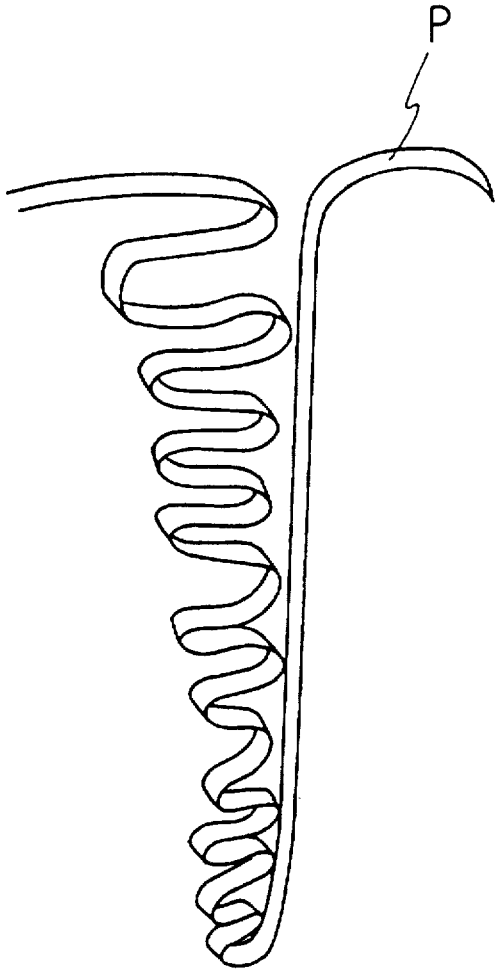
FIG. 5 illustrates a state of the paper which is contained in a stock tank section of a conventional photo-processing apparatus.
Figure 6:
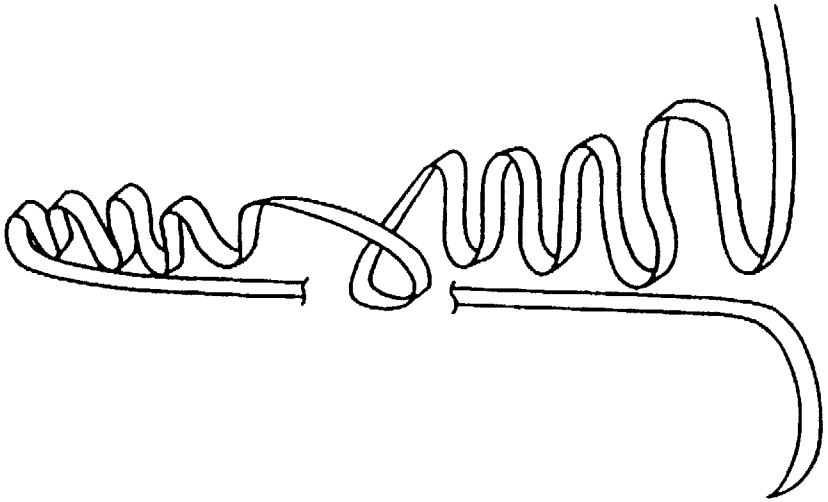
FIG. 6 illustrates a state of the paper which is contained in the stock tank section of a conventional photo-processing apparatus.

FIG. 1 illustrates an embodiment of a photo-processing apparatus of the present invention, FIG. 2 illustrates somewhat schematically the material guide plates disposed in the stock tank section in the photo-processing apparatus of the present invention, FIG. 3 illustrates a state of the paper contained in the stock tank section in FIG. 2, and FIG. 4 illustrates a state of the paper in the case where the width of the material guide path in the stock tank section in FIG. 2 is not changed.

As a configuration of the photo-processing apparatus of the present invention, it is possible to use a conventional one. The configuration of an embodiment of the photo-processing apparatus of the present invention shown in FIG. 1 is the same as that described above. The difference of the present invention from the prior art described above is that a guide path width changing mechanism for changing the width dimension between the guide plates in the stock tank section 7 is provided in the stock tank section 7.

In FIG. 2, a schematic representation of the stock tank section in the present invention comprises a pair of guide plates 21, 22 made of iron-group metal plate, and the like, a plurality of supporting shafts, 23*a*, 23*b*, and 23*c* made of stainless steel, brass, and the like, and a path width changing mechanism (not shown) which moves the guide plates 21, 22 in the transverse direction of the paper P.

The guide plates 21, 22 are thin plates and are disposed between the paper transfer section 6 and exit section 8 to be paired on the both sides of the paper and to sandwich between them the paper in the transverse direction. Thus, the paper fed from the paper transfer section 6 is gathered between the guide plates 21, 22 along a portion of its length, and is contained and stored until it is sent to the processor section 2 from the exit section 8. Moreover, the guide plates 21, 22 have shaft insertion holes 25, 26 and are supported by the supporting shafts 23*a*, 23*b* and 23*c*.

The both ends of the supporting shafts 23*a*, 23*b* and 23*c* are supported by the rear panel of the printer section 1 and stock tank supporting plate of the photo-processing apparatus.

Figure 7:
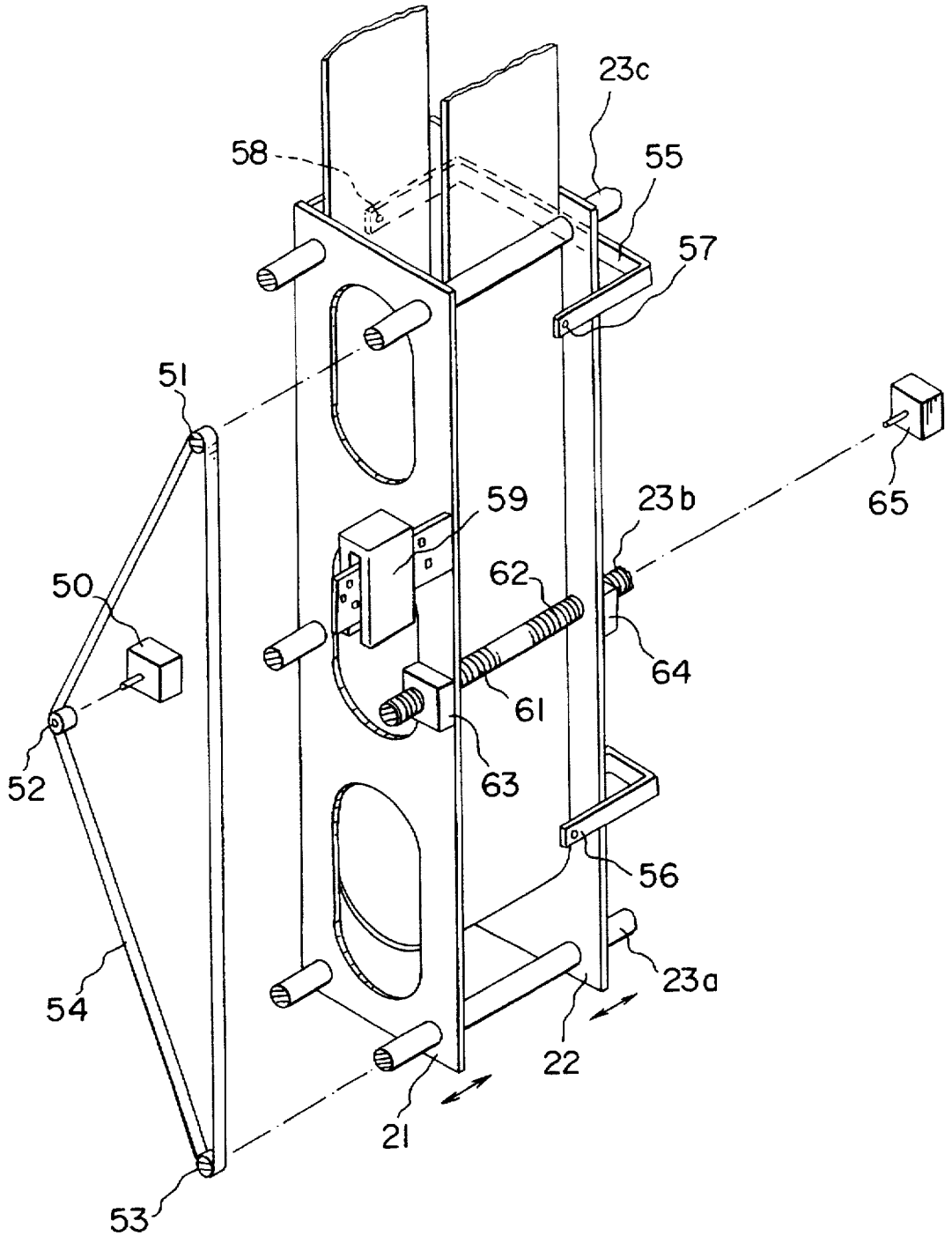
FIG. 7 illustrates one particular form of apparatus according to the invention capable of utilization in the stock tank section of FIG. 1.

As the path width changing mechanism, it is desirable to use, as shown in FIG. 7, for example, a mechanism wherein at least one of the supporting shaft 23*a*, 23*b*, 23*c* is divided into threaded right- and left-screw sections 61, 62 and the supporting shaft insertion holes 25, 26 are correspondingly threaded holes 63, 64 so that, when the shafts rotate the guide plates 21, 22 are caused to move in opposite directions with an approximate center of the shaft being a border. By doing so, it is possible to adjust the interval L1 shown in FIG. 2 by automatically or manually rotating the supporting shaft 23*b* so as to symmetrically move the guide plates 21, 22. In this case, the unthreaded supporting shafts 23*a* and 23*c* simply serve as a guide for the movement of the guide plate. Moreover, if the supporting shaft 23*b* is automatically rotated, as by means of a motor 65 it is possible to provide pulleys 51 and 53 or the supporting shafts 23*a*, 23*c*, to link respectively through to a driving motor 50 by means of a timing belt 54 or to employ a toothed mechanism (not shown) which is linked to the driving motor.

Figure 8:
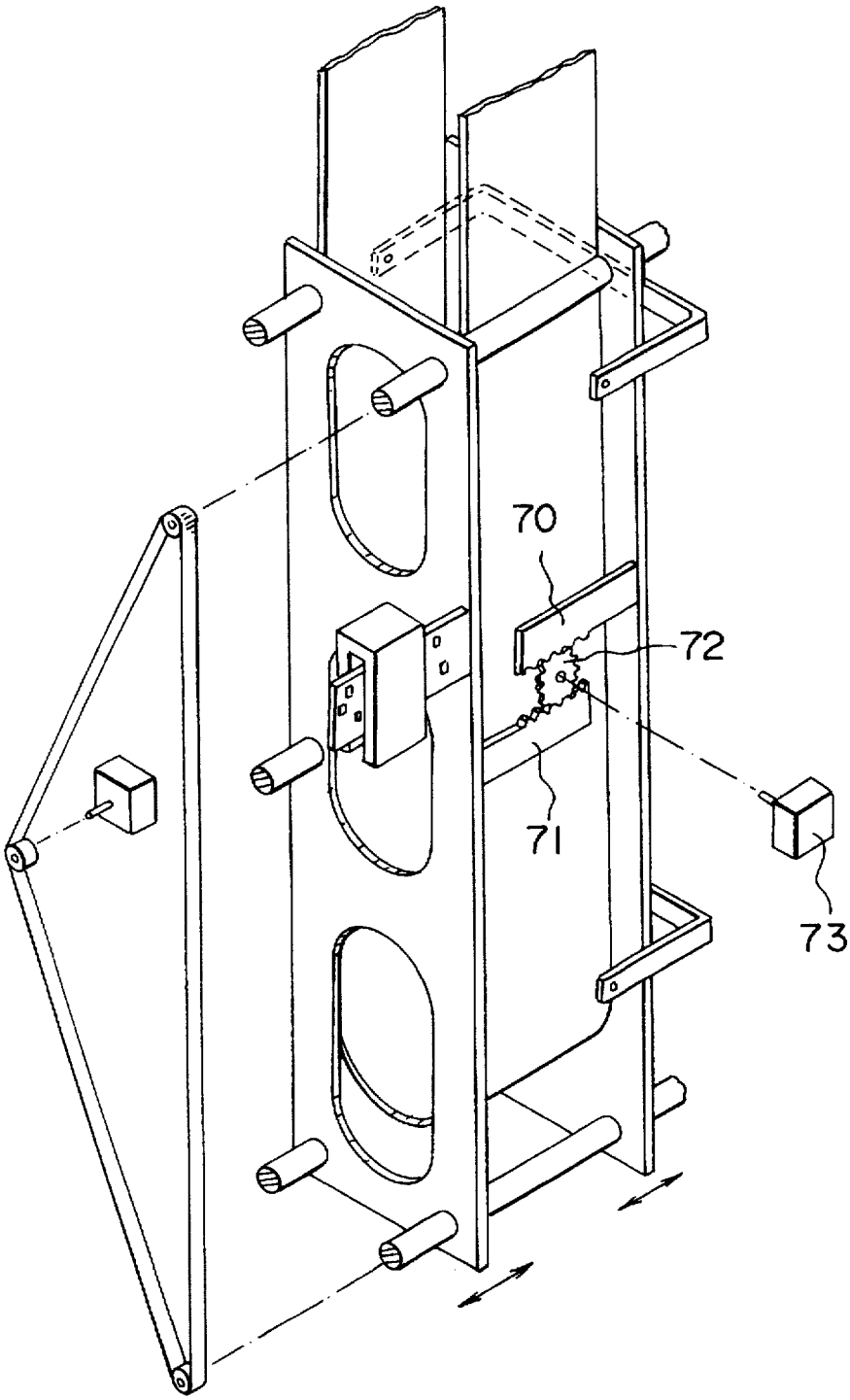
FIG. 8 illustrates another particular form of apparatus according to the invention capable of utilization in the stock tank.

Moreover, as shown in FIG. 8 it is possible to employ a path width changing mechanism in which a rack 70, 71 is provided on each of the guide plates 21, 22 to face each other with a pinion 72 driven by motor 73 being intervened between the teeth of each rack. In this case, the guide plates 21, 22 symmetrically move when the pinion 72 is rotated. It is possible to provide a sensor on the end section of any rack so as to detect the width of the path.

Moreover, it is also possible to provide a sensor as shown at 59 for detecting the width of the paper to be passed through the stock tank section, and sensors, as shown in FIG. 7 at 55,56 for detecting the presence of the paper in the stock tank section as required so as to automatically control the driving motor.

Furthermore, in the above-mentioned path width changing mechanism, it is also possible to provide a supporting shaft rotation mechanism on the supporting shafts other than the threaded shaft. The supporting shaft rotation mechanism is provided to smoothen the movement of the guide plate 21, 22 by rotating the supporting shaft before the guide plates 21, 22 start to slide so as to change static friction to dynamic friction.

In the case of the path width changing mechanism employing the threaded shaft, for example, the center supporting shaft 23*b* and a rotation mechanism such as the timing belt 54 and pulleys 51 and 53, can be connected to the other supporting shafts 23*a*, 23*c*. An automatic or manual rotation mechanism is applicable as in the case of the path width-changing mechanism. If the rotation mechanism is connected to a driving motor via a pulley, it is necessary to adjust the rotation mechanism to start before the path width changing mechanism starts. However, it is possible to terminate the driving at the same time.

Moreover, if a path width changing mechanism is added without threading the supporting shafts, it is desirable to provide a supporting mechanism on each supporting shafts 23*a*, 23*b*, and 23*c*.

In the apparatus with a supporting shaft rotation mechanism as described above, the accuracy of the amount of movement of the guide plates 21, 22 is improved in comparison to the mechanism with the supporting shaft which does not rotate. Namely, in the non-rotatable supporting shaft, sticking dust makes the movement of the guide plate heavier, thereby requiring larger torque or making it difficult to move the guide plate. Furthermore, the guide plate might bind on the supporting shaft, resulting in irregularity of guiding width or inclined guide plate, thereby causing troubles of zigzagging or clogging the paper transfer. However, rotation of the supporting shaft reduces the friction between the width guide and supporting shaft and smoothens the sliding. In the case of the threaded-shaft type, particularly, the load on the feed screws is reduced, which reduces driving torque.

Next, the function of the photo-processing apparatus in the present invention is explained based on FIGS. 3 and 4.

As shown in FIG. 3, if the distance between the guide plates 21, 22 is adjusted to a degree slightly larger than the width of the paper P to be contained and stored between them, small loops are regularly formed from the bottom. The loops wait until the processor section 2 is ready for processing, and are sent from the exit section 8 without being twisted.

However, if the paper P with a width less than L2 is passed between the plates without adjusting the distance L2 between the guide plates 21, 22 as shown in FIG. 4, the contained paper P becomes distorted. Accordingly, not only extra force to pull out the paper is required but also a danger of clogging the exit section 8 with twisted paper is generated.

As described above, the photo-processing apparatus of the present invention has a path width changing mechanism in the stock tank section so that the paper to be contained and stored in the stock tank section does not twist and is smoothly pulled out from the exit section by a method wherein the distance between one pair of guide plates restricting the movement of the paper in the transversal direction is adjusted depending on the width of the paper to be passed through the stock tank section.

Furthermore, provision of a supporting shaft rotation mechanism reduces the friction between the supporting shaft and the guide plates to smoothen the sliding of the guide plates so that the moving amount of the guide plates is accurately controlled, without irregular guiding width and, thus, without trouble in paper transfer.

Though several embodiments of the present invention are described above, it is to be understood that the present invention is not limited only to the above-mentioned and various changes and modifications might be made in the invention without departing from the spirit and scope thereof.

What is claimed is:

1. A photo-processing apparatus having a stock tank section which contains and stores a strip-shaped photo-sensitive material, said stock tank section including a pair of guide plates disposed in said stock tank section and being oppositely spaced in a transverse direction to guide said strip material along a looped path of travel through said stock tank section, and a guide path width-changing mechanism comprising:

a plurality of unthreaded, rotatable guide plate supporting shafts disposed at spaced locations along the length of said guide plates, axially aligned holes in said opposed guide plates receiving said supporting shafts, means for moving at least one of said guide plates in the transverse direction to change the distance between the plates in the transverse direction to alter the guide path width in response to the width of the photo-sensitive material to be passed through the stock tank section, means for rotating said supporting shafts as said guide plates are moved in said transverse direction;

means for sensing the width of the photo-sensitive material to be passed to said tank section, and means connecting said sensing means to said guide plate moving means for moving said at least one guide plate in response to said width of said photo-sensitive material.

2. A photo-processing apparatus having a stock tank section which contains and stores a strip-shaped photo-sensitive material, said stock tank section including a pair of guide plates disposed in said stock tank section and oppositely spaced in a transverse direction to guide said strip material along a looped path of travel through said stock tank section, and a guide path width-changing mechanism comprising:

a plurality of unthreaded, rotatable guide plate supporting shafts disposed at spaced locations along the length of said guide plates, axially aligned holes in said opposed guide plates receiving said supporting shafts for rotation, means for moving at least one of said guide plates in the transverse direction to change the distance between the plates in the transverse direction to alter the guide path width in response to the width of the photo-sensitive material to be passed through the stock tank section, and means for rotating said supporting shafts as said guide plates are moved in said transverse direction.

3. A photo-processing apparatus according to claim 2 in which said guide plate moving means comprises a rack disposed on each of said guide plates in oppositely facing relation and pinion means cooperable with each said rack for adjusting the relative distance between said plates in a plate transversal direction.

4. A photo-processing apparatus according to claim 2 wherein said guide plate moving means comprises a rotatable shaft extending between said guide plates and containing screw threads having opposite inclination at opposite ends thereof and holes in said guide plates receiving said screw thread-containing shaft having internal threads whose inclination corresponds to the screw threads on said supporting shaft.

5. A photo-processing apparatus according to claim 2 wherein said means for rotating said supporting shafts as said guide plates are moved are separate from said guide plate moving means.

* * * * *